United States Patent [19]

Levenez

[11] Patent Number: 4,492,062

[45] Date of Patent: Jan. 8, 1985

[54] WINDOW SILL

[76] Inventor: Pierre Levenez, Rochefoy, Villars, Loire, France

[21] Appl. No.: 387,589

[22] Filed: Jun. 11, 1982

[30] Foreign Application Priority Data

Jun. 11, 1981 [FR] France ..... 81 11887

[51] Int. Cl.[3] ..... F04D 13/00

[52] U.S. Cl. ..... 52/97; 52/209; 52/211; 52/741

[58] Field of Search ..... 52/97, 204, 58, 209, 52/211, 741

[56] References Cited

U.S. PATENT DOCUMENTS

| | | | |
|---|---|---|---|
| Re. 24,027 | 6/1955 | Bourne | 52/97 |
| 2,685,712 | 8/1954 | Tennison | 52/97 X |
| 2,697,932 | 12/1954 | Goodwin | 52/97 |

FOREIGN PATENT DOCUMENTS

| | | | |
|---|---|---|---|
| 244043 | 4/1965 | Austria | 52/97 |

*Primary Examiner*—John E. Murtagh
*Assistant Examiner*—Kathryn L. Ford
*Attorney, Agent, or Firm*—Remy J. VanOphem

[57] ABSTRACT

A window sill assembly for protecting and covering an existing window sill at the base of a window. Two elongated members, each provided with a slideway, are attached to the window sill in a parallel and spaced apart relationship, one member on either side of the sill and extending away therefrom. A rectangular plate is slid, in a manner similar to a drawer, along the slideways until the rear portion of the cover encounters the wall below the window. The cover is then fastened to the sill, for example by being screwed thereto. Alternately, a flat rigid strip is rigidly fastened to the sill under the cover and is provided with a prong extending therefrom. A lip extending from the cover engages the prong and interlocks the plate with the strip.

12 Claims, 12 Drawing Figures

WINDOW SILL

BACKGROUND OF THE INVENTION

1. Field of the Invention

The present invention relates to a window sill of a new type, and more particularly to a window sill of the kind used in the building industry.

2. Description of the Prior Art

It is known to provide a window with an elongated slab is which placed on the outside of the structure associated with the window and arranged with an inclination to the horizontal at the level of the lower edge of the window. The slab, or sill, slopes downwardly towards the outside of the structure and has the purpose of collecting moisture or rain water. The slab, or sill, therefore constitutes a coping which extends beyond the outer face of the outer wall of the structure.

In this way, rain water or moisture is prevented from running down along the outer wall, and is instead ejected some distance from the outer wall.

Of course, this system could not operate if the slab or the sill did not project beyond the outer face of the outer wall.

Currently, there is a tendency to insulate buildings so as to conserve energy and reduce heating costs. This insulation is often accomplished by applying slabs of foam or insulating materials to the outer face of the outer walls. Insulating in this manner increases the thickness of the wall to create a new outer wall beyond which the lower outer edge of the inclined slab, or sill no longer extends. The result is that the rain water flowing down along the sill comes to run down on the new outer wall of insulating material, or between the new outer wall and the outer face of the original wall which, ultimately, deteriorates the new insulated wall and causes it to rot.

The present invention has the objective of avoiding this disadvantage by creating a new arrangement capable of being applied to already existing window sills to increase the offset of the whole towards the outside and to permit outer insulation of the building walls.

SUMMARY OF THE INVENTION

A new window sill according to the invention is intended to be applied onto the existing sill forming the lower part of the frame.

The window sill of the present invention has a plate or cover capable of covering the existing sill of a window which has a width smaller than its own. The plate or cover has a downwardly turned outer edge. The window sill further has:

Two fixed lateral slideways or elongated side members, each having a U-shaped cross section the inner vertical flange of which is shorter than the outer vertical flange. Each of these two flanges is turned-down at its top toward the central longitudinal axis of the slideway.

At least one fastener is provided, consisting of a flat rigid strip capable of being rigidly fastened onto the sill under the cover, with an outer prong turned downwardly which can be fastened by the application of a force under the turned-down edge of the cover.

According to another characteristic of the invention, the rear edge of the plate or cover projects upwardly so as to be made to fit under the horizontal part of the window frame.

According to another characteristic of the invention, each of the two slideways is equipped with a flexible joint, formed from rubber or any other suitable material, which is intended to lock the plate of sheet metal or plastic constituting the cover to the slideways.

According to another characteristic of the invention, the arrangement also includes two ornamental caps made of molded material which are each intended to be fitted into the free end of the corresponding fixed slideway after the cover is installed, so as to constitute a finishing ornamental trim for the window sill.

The attached drawings, provided as a nonlimiting example, will make it possible to better understand the characteristics of the present invention.

DETAILED DESCRIPTION OF THE PREFERRED EMBODIMENT

Figure 1:
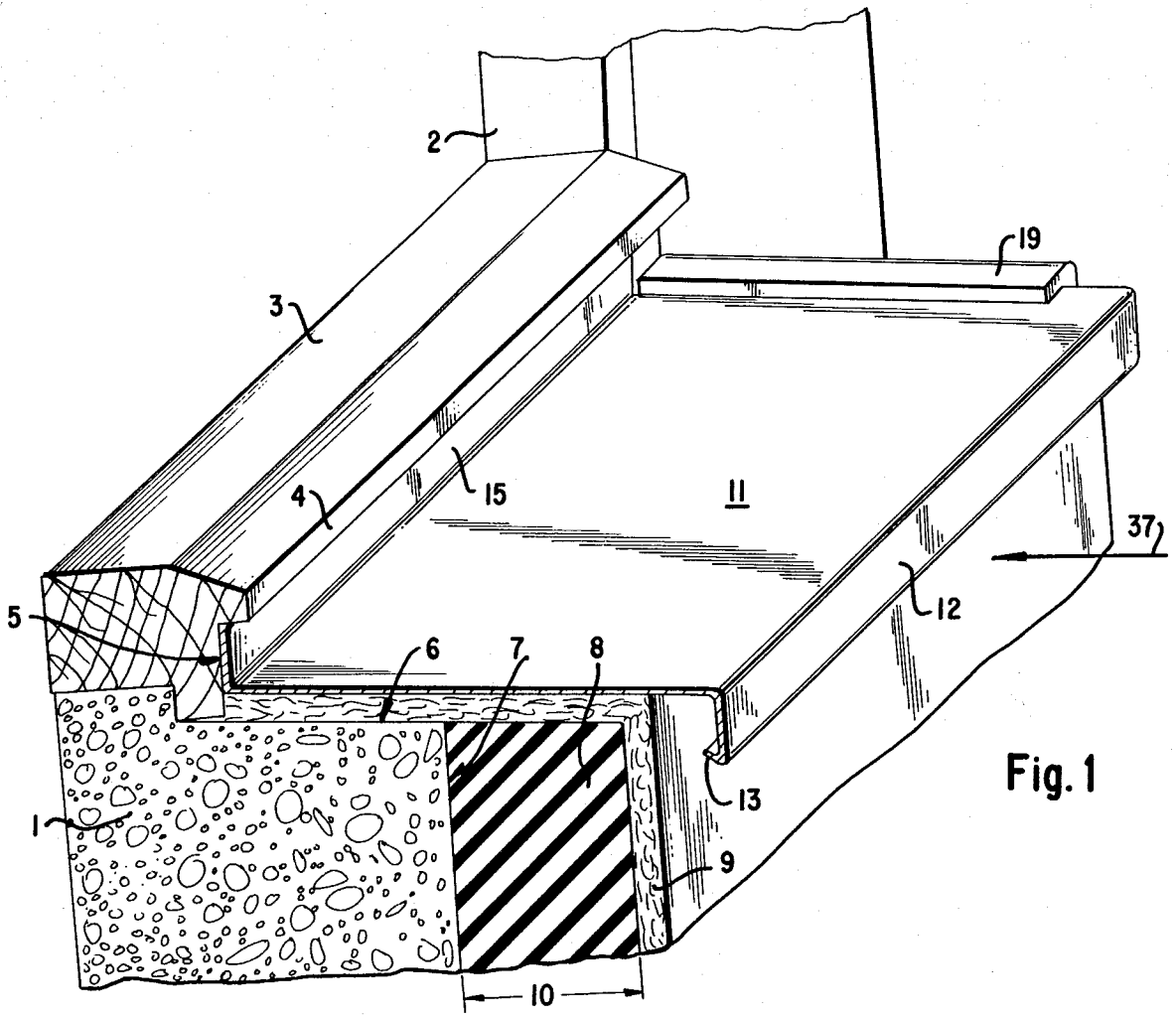
FIG. 1 is a perspective view with a partial section showing an arrangement according to the invention after it is mounted on an existing window sill.

FIG. 1 shows a wall 1 in which a window frame is mounted in the usual manner. This frame includes vertical casings 2 and a lower horizontal crosspiece 3. This crosspiece 3 has a longitudinal molding which extends toward the front forming a shaped tip 4 which overhangs a vertical wall 5. The crosspiece 3 and the shaped tip 4 and vertical wall 5 thereof are well known in the art and together constitute the lower casing.

In front of the crosspiece 3, the top of the wall 1 has a transverse face 6 which is slightly inclined downwardly towards the outside and which constitutes what is called the window sill.

According to a known technique, if it is wished to insulate the wall 1 externally, plates or slabs 8 of an insulating material are applied onto its outer face 7. This may involve plates of foam or of a molded cellular product. The unit is usually coated with a layer 9 of rough plaster or dressing.

In all cases it is seen that the thickness of the wall 1 is increased by an amount 10 on its outer face.

The present invention has the aim of covering and protecting the window sill 6, and particularly of preventing any infiltration of water running down along the outer face 7 and under the layer 9.

The arrangement according to the invention includes a cover 11 which is in the form of a plate of sheet metal or of plastic material suitably bent and indented. This may also be formed from an aluminum plate which has the advantage of better resistance to bad weather.

The plate constituting the cover 11 is elongated and substantially rectangular in shape, and has an outer edge which is turned-down. The free end of the outer edge 12 itself is bent backwardly towards the inside and upwardly therefrom to form a tip 13.

Figures 5, 6:
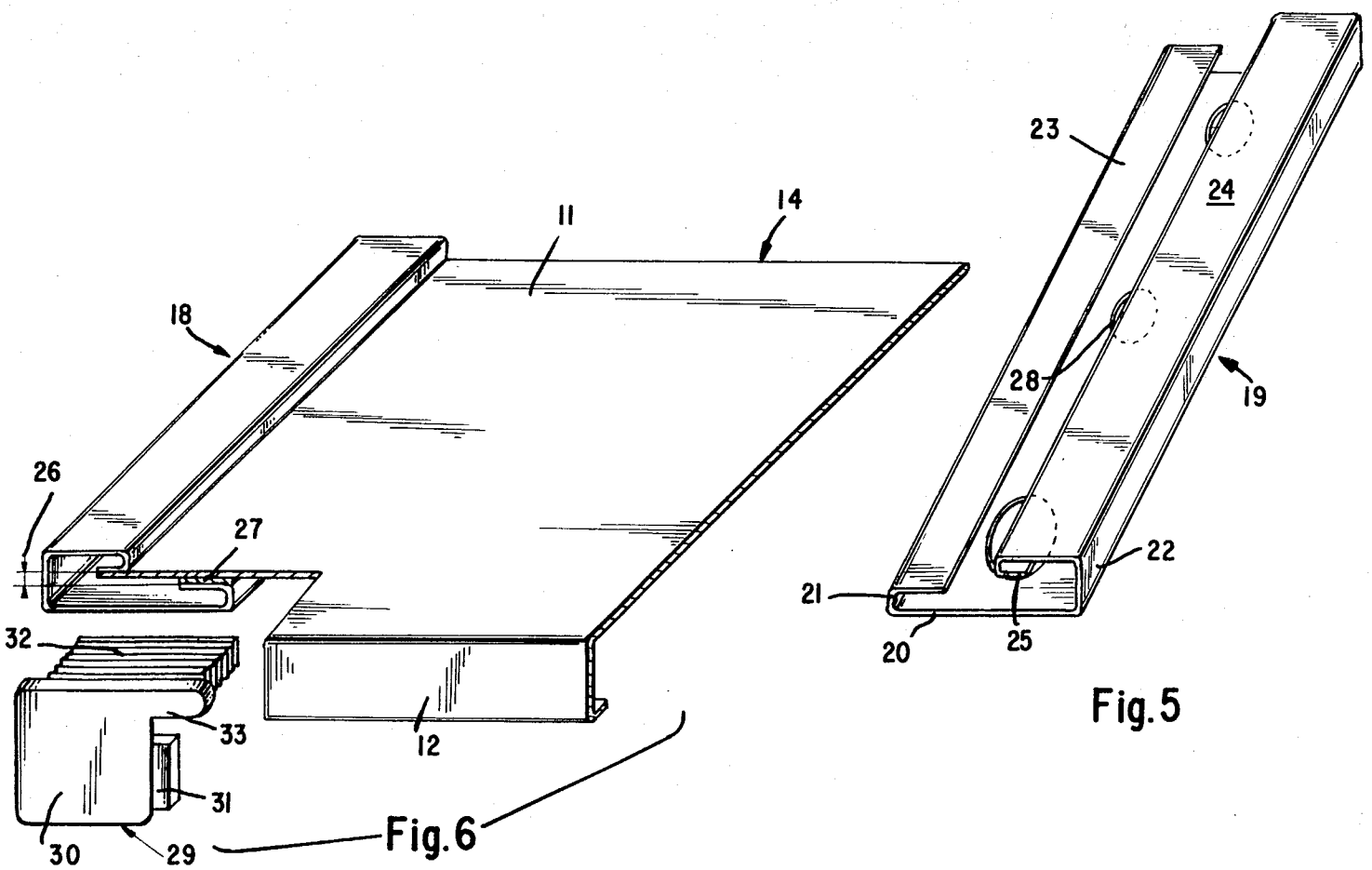
FIG. 5 is a perspective view of one of the lateral slideways.
FIG. 6 is a partial exploded view showing the arrangement of one end of the cover in its slideway, with an ornamental cap installed.

In the example illustrated in FIG. 6, the rear edge 14 of the cover 11 remains protuberant. By contrast, in the example illustrated in FIGS. 1 to 3, this rear edge projects upwardly to form a vertical supporting face 15.

Figure 2:
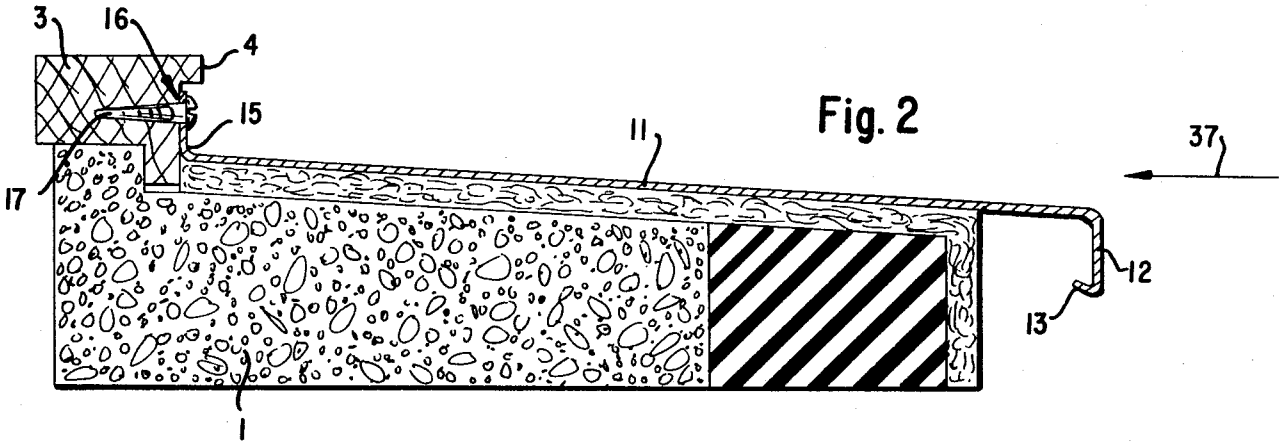
FIG. 2 is a vertical sectional view showing a first example of a method for attaching the cover to the existing sill.

In the modification of FIG. 2, the vertical supporting face is provided with perforations 16 in which fastening screws 17 can be engaged.

The arrangement according to the invention also has two fixed slideways such as 18 and 19 as viewed in FIGS. 5 and 6, namely a right slideway 19 and a left slideway 18. These two slideways 18, 19 may be cut as sections from the same piece of sectional steel where the U-shaped cross-section forms a bottom 20. The latter is situated between an inner flange 21 projecting vertically upwardly and an outer flange 22 also projecting vertically upwardly but higher than the flange 21.

Moreover, the top of the inner flange 21 is turned inwardly toward the interior and parallel to the bottom 20 to form a shoulder part 23. Likewise, the upper edge of the outer flange 22 is turned upwardly toward the interior and parallel to the bottom 20 to form another shoulder part 24 under which still another edge 25 is folded back which is also parallel to the bottom 20.

The whole unit is dimensioned in such a way that the thickness 26 separating the interface of the shoulder part 23 and the edge 25 is substantially equal to the thickness of the cover 11 increased by that of a flexible joint 27. The latter may consist of a segment of a flat band of rubber or plastic which is placed onto the shoulder part 23 and may be fastened, for example by means of an adhesive, thereto.

Finally, holes 28 are pierced in the bottom 20 of each slideway 18 or 19.

The arrangement also has two ornamental caps 29. Each of these is molded for example from plastic material. Each cap includes a visible ornamental plate 30 on the side of which extends a recessed projection 31 intended to be shielded behind the outer edge 12 of the cover 11. Moreover the rear face of the plate 30 has a channel shaped projection 32 intended to be forced into the end of the corresponding slideway 18 or 19. Finally the visible ornamental plate 30 has a substantially square shape, ending in a tip 33 which extends at an angle so as to be made to fit in the corresponding slideway 18 or 19.

Figure 3:
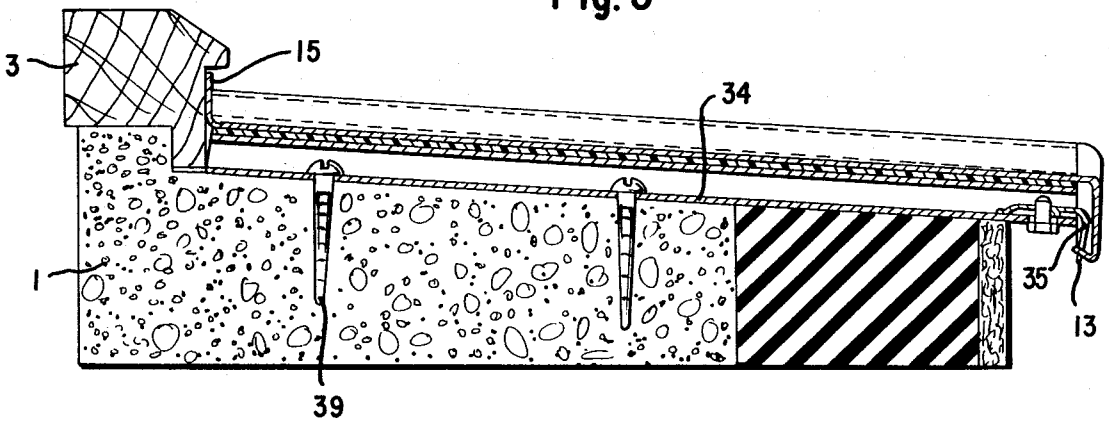
FIG. 3 is a sectional view similar to FIG. 2 but showing another example of a method for attaching the cover.
Figure 4:
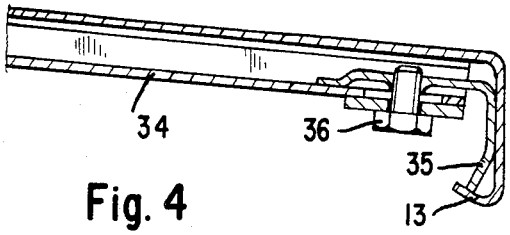
FIG. 4 is a partial vertical sectional view similar to FIG. 3 but showing additional details.
Figure 7:
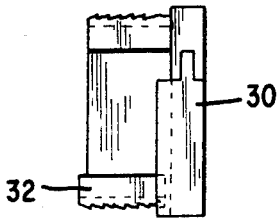
FIG. 7 is a partial bottom view of an ornamental trim tip according to the invention.
Figure 8:
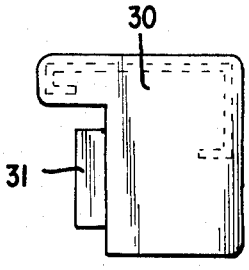
FIG. 8 is a front elevational view of the ornamental cap of FIG. 7.
Figure 9:
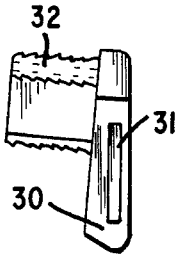
FIG. 9 is a lateral view thereof.
Figure 12:
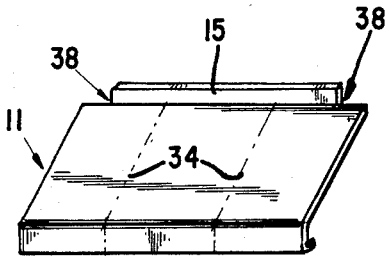
FIG. 12 shows in perspective a possible modified embodiment of the cover.
Figure 11:
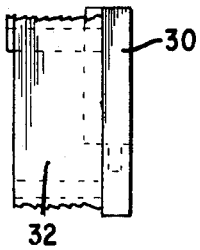
FIG. 11 is a bottom view from below.

Modifications illustrated in FIGS. 3, 4 and 12 have fasteners, each of which consists of a hoop iron 34 or the like, which is to be fastened onto the window sill 6. At its outer end each hoop iron 34 is interconnected with a hook 35 fixed by a screw 36. The tip of each hook 35 extends downwardly and is capable of being clipped under the tip 13 of the cover 11 when the latter is engaged in the slideways 18 and 19.

The operation of the present invention is as follows: If it is proposed to insulate a wall 1, installing insulations 8 and 9 increases the thickness of the wall by an amount 10 (FIG. 1). Consequently at the level of the window sill 6 of each window it is proposed to install an arrangement according to the invention.

Figure 10:
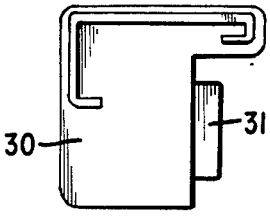
FIG. 10 is a rear view thereof.

To install the arrangement of the present invention, a slideway 18 or 19 (FIG. 10) is first fastened on each of the two sides of the frame. This fastening may be done very easily, and from above, by putting in screws in the holes 28 in the bottom 20 of each slideway (FIG. 5). The shoulder part 23 of each slideway 18 or 19 is equipped in advance with a flexible joint 27 made of rubber or plastic. Finally the cover 11 is brought in front of the slideways 18 and 19, and is made to slide in the slideways 18 and 19 in the manner, as indicated by the arrows 37 FIG. 1. For this sliding operation, the upper face of the cover 11 is inserted between the flexible joint 27 on which it rests and the edge 25 which prevents it from rising. To facilitate this sliding operation, at each end of the vertical supporting face 15 of the cover 11 is provided a notch 38 (FIG. 12) which is caused to be inserted around the slideway 18 or 19 during its installation.

After the cover 11 has been fully advanced along the slideways 18 and 19, the cover 11 is fastened in place.

In the case of FIGS. 1 and 2, this fastening is done by perforation of the vertical supporting face 15 and inserting the fastening screws 17 which are screwed onto the vertical wall 5 of the crosspiece 3 under the tip 4 of the crosspiece 3.

Alternatively, in the case of FIGS. 3 and 4, the fastening is done by clipping the tip 13 of the cover 11 under the hook 35 of each hoop iron 34, or the like, the hoop irons 34 being fastened by screws 39 under the window sill.

To improve the fastening of the cover 11, and particularly to prevent it from moving under the action of wind, the two above-mentioned methods of fastening the cover may be combined. For example, two or more hoop irons may be provided, the hoop irons being distributed in intermediate positions along the length of the cover 11, as indicated in FIG. 12.

After installation of the unit as indicated in FIG. 1, the assembly is completed by attaching an ornamental cap 29 each to the free end of one of the slideways 18 or 19.

As will be apparent from the above to a person of ordinary skill in the art, the principal advantages of the invention are as follows: Water is prevented from getting into the insulation 8 or dressing 9 of the wall 1. The upper end of the insulation 8 is protected. The sheet metal or the like forming the cover 11, being installed at the last moment, does not interfere in any way with carrying out preliminary insulation work. The cover 11, being installed at the last moment, is not damaged once it has been put on and maintains a new and perfect appearance. The device according to the invention may be applied equally well to new buildings and to already existing windows. If water happens to seep in laterally, the cross-section of the slideways 18 and 19 prevents its seeping under the cover 11 and insures that it will flow down to the outside. Finally, the rubber joint 27 locks the cover plate and fixes it in the slideways.

I claim:

1. A window sill assembly for protecting and covering an exterior insulated wall adjacent an existing window sill at a base of a window, said window sill assembly comprising:

two elongated side members disposed opposite each other at said base of said window;

first fastening means for fastening said two elongated side members to said existing window sill in a spaced apart relationship such that said two elongated side members extend outwardly a predetermined distance from said base;

a rectangular plate mounted to said two elongated side members and disposed contiguous said existing window sill, said rectangular plate having one edge cooperating with one of said two elongated side members and an opposite edge cooperating with the other of said two elongated side members;

means for guiding said rectangular plate interposed said one edge of said rectangular plate and said one of said two elongated side members, said means for guiding further being interposed said opposite edge of said rectangular plate and said other of said two elongated side members to receive said one edge and said opposite edge of said rectangular plate for communication therewith, said rectangular plate further abutting said base of said window and being contiguous said existing window sill and said exterior insulated wall whereby any water collecting on said rectangular plate drains away from said base along said rectangular plate and is prevented from draining into said exterior insulated wall; and second fastening means for fastening said rectangular plate to said existing window sill.

2. The window sill assembly of claim 1 wherein each of said two elongated side members has a substantially U-shaped cross-section and each of said two elongated side members comprises a base portion, an outer vertical flange and an inner vertical flange shorter than said outer vertical flange, a first longitudinal shoulder portion extending inwardly from said inner vertical flange and parallel to said base portion, and a second longitudinal shoulder portion extending from said outer vertical flange towards the longitudinal axis of each of said two elongated side members parallel to said base portion.

3. The window sill assembly of claim 2 further comprising an elongated resilient member disposed along said first longitudinal shoulder portion of each of said two elongated side members.

4. The window sill assembly of claim 1 wherein said second fastening means comprises:

a flat strip having a prong extending therefrom;

a lip extending from said rectangular plate operable to engage said prong; and means for fastening said flat strip to said existing window sill.

5. The window sill assembly of claim 1 wherein said window has a lower casing and further wherein said rectangular plate comprises an upwardly extending flange such that when said rectangular plate rests along said means for guiding in a predetermined location, said upwardly extending flange is fitted under said lower casing of said window against said base of said window.

6. The window sill assembly of claim 1 further comprising two caps, each of said two caps selectively interconnecting each end of said two elongated side members furthest from said window.

7. The window sill assembly of claim 6 wherein each of said two elongated side members has a substantially U-shaped cross-section along its entire length and wherein each of said two caps has a projection forced fitted into said each end of one of said two elongated side members furthest from said window.

8. The window sill assembly of claim 5 further comprising at least one aperture in said upwardly extending flange of said rectangular plate, and further wherein said rectangular plate is fastened to said base of said window by means of a fastener extending partially through said at least one aperture in said upwardly extending flange.

9. The window sill assembly of claim 5 wherein said upwardly extending flange comprises notches.

10. A method for covering and protecting an exterior insulated wall adjacent an existing window sill at a base of a window, said method comprising the steps of:

fastening two elongated side members to said existing window sill, each of said two elongated side members having means for guiding defined therealong; and positioning a rectangular plate along said means for guiding until said rectangular plate abuts said base of said window and is contiguous said existing window sill and said exterior insulated wall whereby water collecting on said rectangular plate drains away from said base of said window and is prevented from draining into said exterior insulated wall.

11. The method of claim 10 further including the step of securing said rectangular plate to said existing window sill.

12. The method of claim 10 further including the step of securing said rectangular plate to said base of said window.

* * * * *

UNITED STATES PATENT AND TRADEMARK OFFICE

CERTIFICATE OF CORRECTION

PATENT NO. : 4,492,062

DATED : January 8, 1985

INVENTOR(S) : Pierre Levenez

It is certified that error appears in the above-identified patent and that said Letters Patent is hereby corrected as shown below:

Column 1, line 11, delete "slab is which" and insert ---- slab which is ----. Same line, delete "the structure" and insert ---- a structure ----.

Signed and Sealed this

*Fourteenth* Day of *May 1985*

[SEAL]

*Attest:*

DONALD J. QUIGG

*Attesting Officer* *Acting Commissioner of Patents and Trademarks*